US006832590B2

(12) United States Patent
Hattori et al.

(10) Patent No.: US 6,832,590 B2
(45) Date of Patent: Dec. 21, 2004

(54) INTERNAL COMBUSTION ENGINE

(75) Inventors: Katsutaka Hattori, Saitama (JP); Katsuhiro Nakamichi, Saitama (JP); Isamu Takahashi, Saitama (JP)

(73) Assignee: Honda Giken Kogyo Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/309,014

(22) Filed: Dec. 4, 2002

(65) Prior Publication Data

US 2003/0217724 A1 Nov. 27, 2003

(30) Foreign Application Priority Data

Dec. 25, 2001 (JP) ..... 2001-391037
Dec. 25, 2001 (JP) ..... 2001-391038

(51) Int. Cl.[7] ..... F02F 7/00
(52) U.S. Cl. ..... 123/195 R; 180/226; 180/230
(58) Field of Search ..... 123/195 R, 54.4; 180/219, 226, 230

(56) References Cited

FOREIGN PATENT DOCUMENTS

DE 2757729 A1 * 6/1978
JP 2858017 12/1998

* cited by examiner

*Primary Examiner*—Noah P. Kamen
(74) *Attorney, Agent, or Firm*—Birch, Stewart, Kolasch & Birch, LLP

(57) ABSTRACT

An internal combustion engine includes a crankshaft, a mainshaft, a clutch and a countershaft. The mainshaft is for a transmission and holds a transmission gear train. The clutch is disposed on the extension of the mainshaft. Furthermore, the countershaft for the transmission holds a gear train to mesh with the transmission gear train. Accordingly, power is transmitted in order from the crankshaft to the clutch, the mainshaft, and the countershaft. This arrangement ensures better knee-grip when the internal combustion engine is mounted on a vehicle and improves in-vehicle mountability by reducing the width and the axial length of the internal combustion engine. A mainshaft is disposed about immediately below the crankshaft. At least a part of the mainshaft is provided at the same axial position as the crankshaft.

17 Claims, 9 Drawing Sheets

INTERNAL COMBUSTION ENGINE

CROSS-REFERENCE TO RELATED APPLICATIONS

This nonprovisional application claims priority under 35 U.S.C. §119(a) on Patent Application Nos. 2001-391037 and 2001-391038, each filed in Japan on Dec. 25, 2001. The entirety of each of the above documents is hereby incorporated by reference.

BACKGROUND OF THE INVENTION

1. Field of the Invention

The present invention relates to an internal combustion engine, which is suitable as a power unit for a vehicle.

2. Description of Background Art

An internal combustion engine used for a motorcycle in the background art has been disclosed in Japanese Patent No. 2858017. In the internal combustion engine in the background art, the center line of the crankshaft is disposed on the center plane of the vehicle body along the longitudinal direction. A clutch and a gear shifter are disposed on one of the left and the right sides below the crankshaft. Furthermore, an auxiliary drive system including a starting motor, an electric generator, and the like is disposed on the other side. The mainshaft and the countershaft of the gear shifter including a transmission gear set are disposed in parallel with the crankshaft, but rearwardly of the crankshaft in the axial direction. A transmission case for accommodating these members is connected to the back of the crankcase.

In the internal combustion engine in the background art, a clutch having a large diameter is disposed on one of the left and the right sides on the center plane of the vehicle body, and the electric generator is disposed on the other side. Therefore, the width of the internal combustion engine increases, and thus the knee-grip capability is lowered. In addition, since a transmission case for accommodating a gear shift is provided rearwardly of the crankcase, the lengthwise dimension of the internal combustion engine increases, and thus in-vehicle mountability decreases.

In addition, in the internal combustion engine in the background art, the mainshaft and the countershaft of a gear shifter having a transmission gear set are disposed in parallel with the crankshaft. However, the axial position thereof is rearwardly of the crankshaft. Furthermore, a transmission case for accommodating these members is connected to the back of the crankcase. As a consequence, when intended to mount the internal combustion engine with the crankshaft oriented lengthwise on the motorcycle, the dimension of the wheelbase increases, which is not preferable.

SUMMARY OF THE INVENTION

In the present invention, the width of the internal combustion engine is reduced, and the axial length is shortened. Accordingly, the knee-grip capability is improved when the internal combustion engine is mounted on the vehicle, and the mounting capability is increased. In addition, the present invention intends to improve the assembling capabilities by applying some other modifications.

Having solved the aforementioned problems, according to a first aspect of the present invention, an internal combustion engine includes a crankshaft, a mainshaft of a transmission for holding a transmission gear train, a clutch disposed on the extension of the mainshaft, and a countershaft of the transmission for holding a gear train to be meshed with the aforementioned transmission gear train. The power is transmitted in order from the crank shaft to the clutch, the main shaft, and the countershaft. In addition, the mainshaft is disposed substantially directly below the crankshaft.

In the above structure, the mainshaft is disposed substantially directly below the crankshaft and the clutch having a large diameter is connected on the forward extension of the mainshaft. In addition, the clutch having a large diameter is positioned at the widthwise center when the internal combustion engine is viewed from the front, or in the direction along the crankshaft. Accordingly, the lateral width of the internal combustion engine may be reduced.

According to a second aspect of the present invention, at least a part of the mainshaft is disposed at the same axial position as the crankshaft. In other words, the mainshaft and the crank shaft are superimposed with each other when viewed from a certain position on the side of the shaft. Therefore, the axial length of the internal combustion engine may be reduced in comparison with the internal combustion engine in Japanese Patent No. 2858017. It also has such effect that oil dropped after lubricating the piston or the crank may be used for lubricating the gear set of the mainshaft.

According to a third aspect of the present invention, a crank chamber is defined by upper and a lower case members, the crankshaft is held between the upper and the lower case members, the mainshaft is adapted to be attached on the lower case member, and at least a part of the crank bearing and the main bearing are shifted with each other so as to be located at the different axial positions. This arrangement allows reduction of the length of the bolt for securing the bearing section for the crankshaft, which contributes to the improvement of workability.

According to a fourth aspect of the present invention, the internal combustion engine is mounted on a motorcycle with the crankshaft oriented lengthwise of the vehicle. Such positional relation between the vehicle and the internal combustion engine allows a reduction of the front projected area of the vehicle, and ensures better knee-grip. In addition, since the lengthwise dimension of the internal combustion engine is shortened, in-vehicle mountability is improved.

According to the fifth aspect of the present invention, the internal combustion engine is a V-type internal combustion engine. In this arrangement, the vertical height of the central portion of the internal combustion engine can be reduced, and thus in-vehicle mountability is improved.

In addition, in order to reduce the entire length of the internal combustion engine in the direction of the axis of the crankshaft, it is required to dispose the crankshaft and the transmission shafts such as a mainshaft at almost the same position in the axial direction. Therefore, it is required to accommodate the transmission shaft and a cam-type torque damper disposed on the extension of the mainshaft in the crankcase. The present invention is intended especially to improve in-vehicle mountability by reducing the length of the cam-type torque damper and shortening the axial length of the internal combustion engine while satisfying the above-described conditions. Furthermore, the present invention is intended to improve the assembly by applying some additional improvements.

Further to the above, according to a sixth aspect of the present invention, an internal combustion engine includes a crankshaft, a mainshaft of a transmission for holding a transmission gear train, a clutch disposed on the axis of the mainshaft, a cam-type torque damper to be disposed on the axis of the mainshaft, and a countershaft of the transmission for holding a gear train to be meshed with the transmission gear train. Power is transmitted in order from the crankshaft to the clutch, the cam-type torque damper, the mainshaft, and the countershaft. Furthermore, a mainshaft and a cam-type torque damper are disposed downwardly of the crankshaft in the crankcase.

According to the sixth aspect of the present invention, the mainshaft is disposed downwardly of the crankshaft. Accordingly, the entire length of the internal combustion engine in the direction of the crankshaft may be reduced in comparison with the internal combustion engine disclosed in Japanese Patent No. 2858017 in which the mainshaft is disposed rearwardly of the crankshaft. In addition, the mainshaft is disposed downwardly of the crankshaft. Accordingly, the mainshaft and the gear shifter continuing therefrom can be accommodated in the crankcase. Therefore, the need to provide a transmission case may be eliminated. Furthermore, the mainshaft and the cam-type torque damper are disposed downwardly of the crankshaft. Accordingly, oil dropped after lubricating the piston or the crank may be used for lubricating the gear set of the mainshaft or the cam-type torque damper.

According to a seventh aspect of the present invention, a bearing between the clutch and the cam-type torque damper is secured to the crankcase via a bearing holding member. In the arrangement of the present invention, since the cam-type torque damper may be assembled through a hole opened on the crankcase for mounting the bearing holding portion with the bearing holding member removed, assembly of the cam-type torque damper can be improved.

According to an eighth aspect of the present invention, the engine is mounted on the motorcycle with the crankshaft oriented lengthwise of the vehicle. The entire length of the internal combustion engine in the direction of the crankshaft is shortened. Accordingly, the length of the wheelbase of the vehicle can be shortened by mounting the crankshaft lengthwise of the vehicle.

According to a ninth aspect of the present invention, the internal combustion engine is a V-type internal combustion engine. In this arrangement, the vertical height of the central portion of the internal combustion engine may be reduced, and thus in-vehicle mountability may be improved.

Further scope of applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
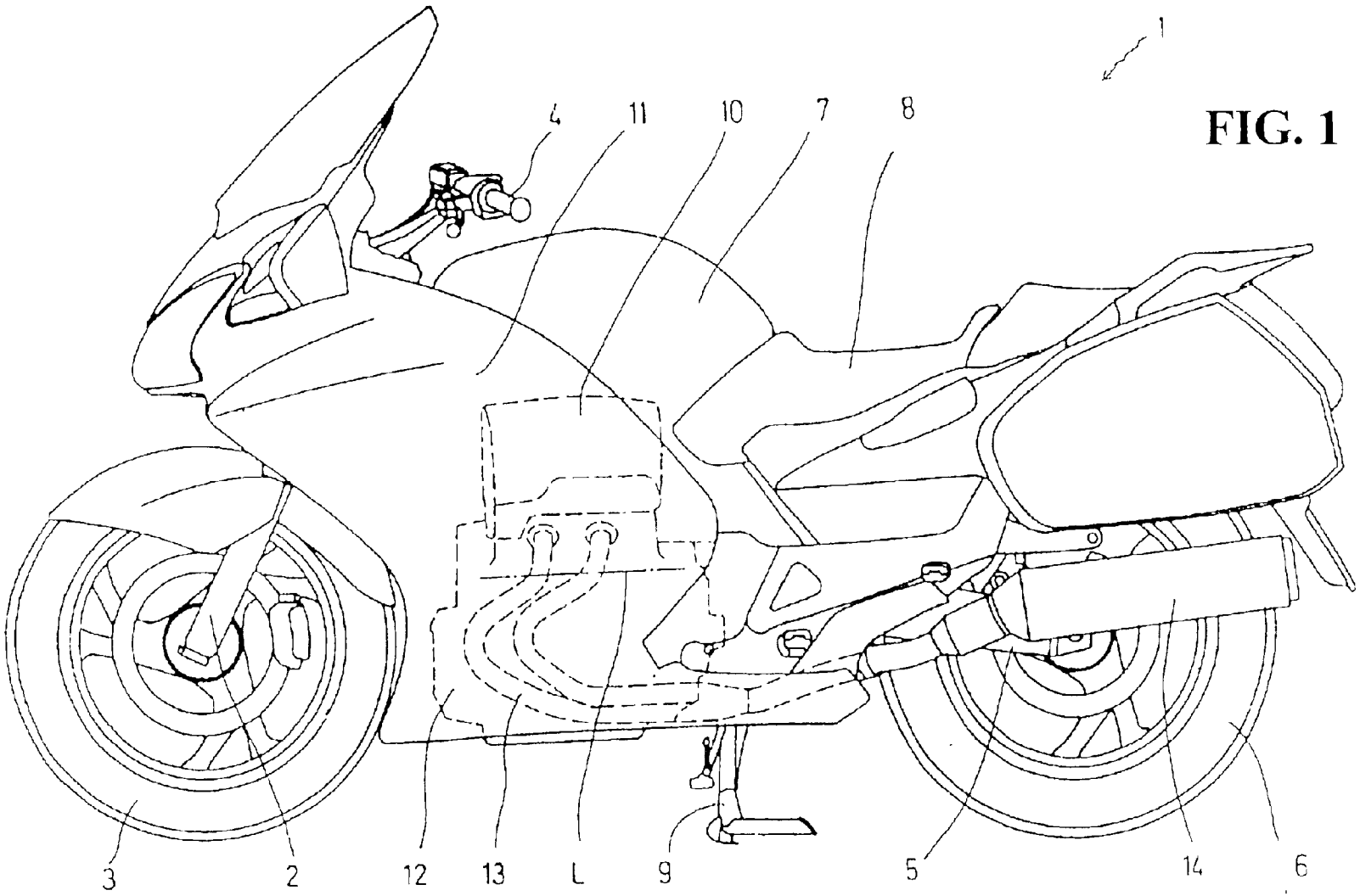
FIG. 1 a side view of the motorcycle having an internal combustion engine according to the present invention mounted thereon.

FIG. 1 is a side view of a motorcycle 1 including an internal combustion engine according to the present invention mounted thereon. A front fork 2 is rotatably supported at the front of the vehicle body frame. A front wheel 3 is rotatably installed at the lower portion of the front fork 2. Furthermore, a steering handle or handlebar 4 is provided at the top of the front fork 2. A rear wheel 6 is rotatably installed on a swing arm 5 connected to the rear portion of the frame. A fuel tank 7 and a seat 8 are installed on top of the frame. A stand 9 is provided below the frame. An internal combustion engine 10 is supported on the central portion of the frame, and is covered by a cowling 11. The internal combustion engine 10 is a V-type 4-cylinder, 4-stroke cycle internal combustion engine having a V-shaped cylinder bank opening laterally at an angle of 90 degrees. The centerline L of the crankshaft lies lengthwise of the vehicle. The internal combustion engine 10 is provided with a transmission mechanism 12 there beneath. Furthermore, the engine is provided with an exhaust pipe 13 extending inflectionally from the central portion of the internal combustion engine toward the rear. A muffler 14 continues from the rear end of the exhaust pipe 13.

Figure 2:
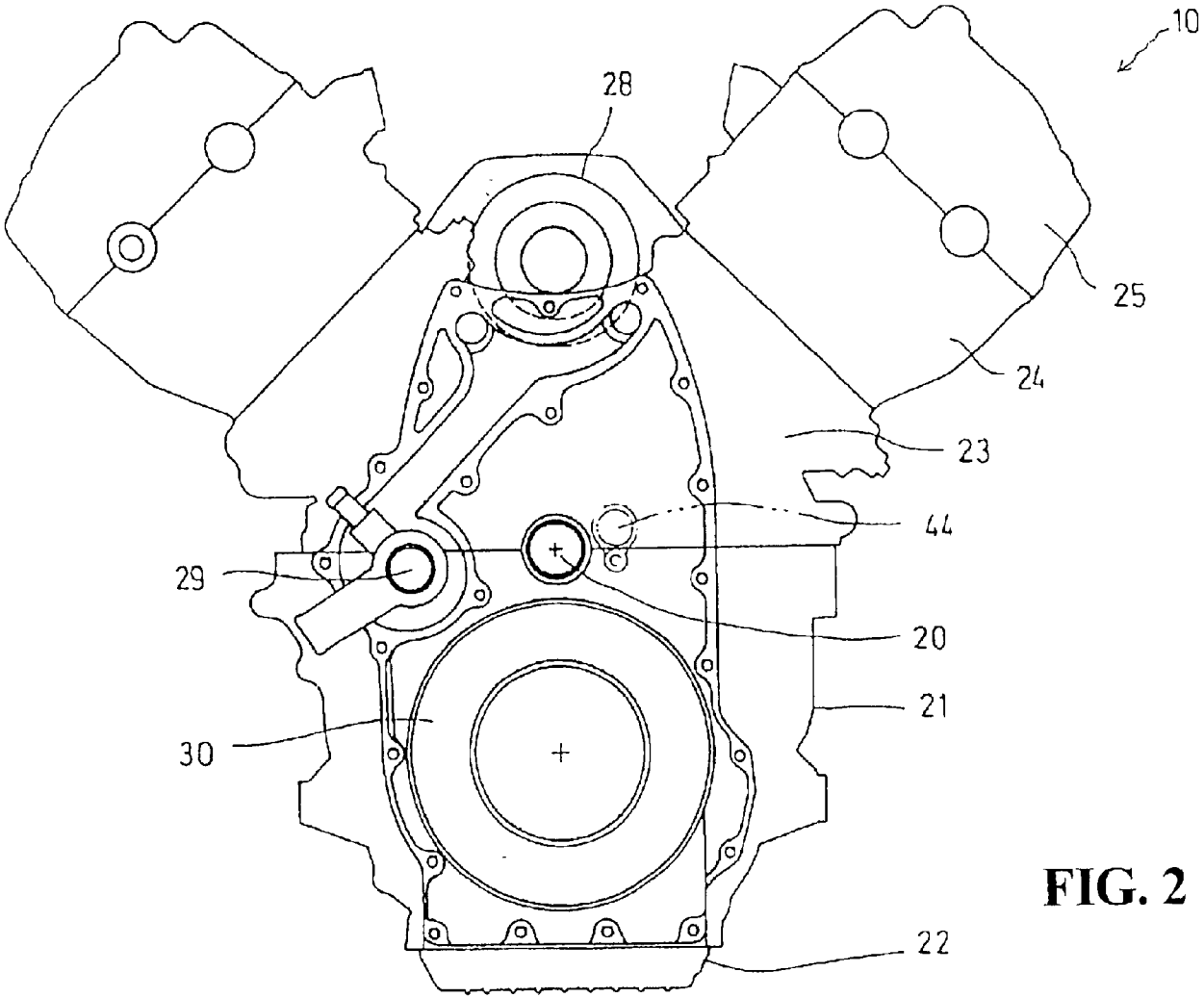
FIG. 2 is a front view of the aforementioned internal combustion engine with the front crankcase cover removed.

FIG. 2, is a drawing of the aforementioned internal combustion engine 10 viewed from the front in a state in which the front crankcase cover is removed. The internal combustion engine 10 has a crankshaft 20 at the center thereof. The crankshaft 20 is clamped and supported between a crankcase 21 on the lower side and a cylinder block 23 on the upper side. The bottom of the crankcase 21 is closed by an oil pan 22. The cylinder block 23 is formed with a pair of front and rear cylinder bores on the left side and on the right side respectively so as to extend toward the upper left and right directions at an angle of 90 degrees and toward the centerline of the crankshaft 20. The cylinder block 23 is provided with cylinder heads 24 on top of the left portion and the right portion thereof respectively so as to continue therefrom. The cylinder head cover 25 continues from the top of each cylinder head 24. An alternate-current generator or alternator 28 is provided upwardly of the crankshaft 20. A cooling water pump 29 is provided at a somewhat lower left position when viewed toward FIG. 2. The crankshaft 20 drives the cooling water pump 29.

A multiple disk frictional clutch 30 having a large diameter is provided immediately under the crankshaft 20 at the front center of the crankcase 21. The input portion thereof is driven by the crankshaft 20 via a gear. The output shaft of the clutch 30 extends from the center of the clutch toward the rear.

Figure 3:
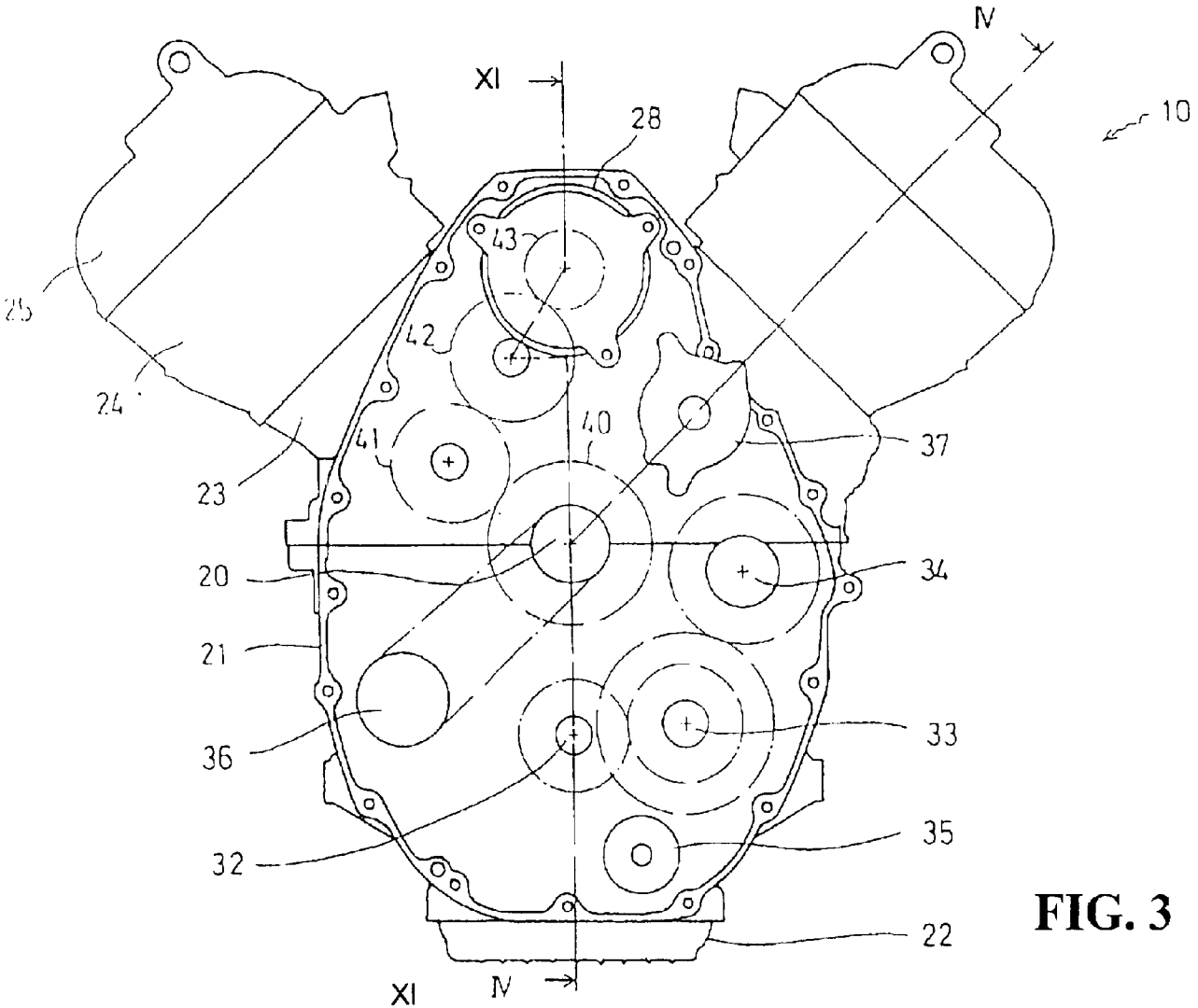
FIG. 3 is a back view of the aforementioned internal combustion engine with the rear crankcase cover removed.

FIG. 3 is a drawing of the aforementioned internal combustion engine 10 viewed from the backside in a state in which the rear crankcase cover is removed. A crankshaft 20 is located at the central portion, and a mainshaft 32 of the gear shifter is located immediately there below. A countershaft 33 is located next to the mainshaft 32, and an output shaft 34 is located obliquely above the countershaft 33. A shift drum 35 is provided downwardly between the mainshaft 32 and the countershaft 33. All of the above members constitute a constant-mesh transmission gear.

An oil pump 36 to be driven by the crankshaft 20 via a chain is provided on the lower left of the crankshaft 20. A starter 37 is provided on the upper right of the crankshaft 20. The alternate-current generator 28 is provided immediately above the crankshaft 20, which is driven by the crankshaft 20 via gears 40, 41, 42, and 43.

Figure 4:
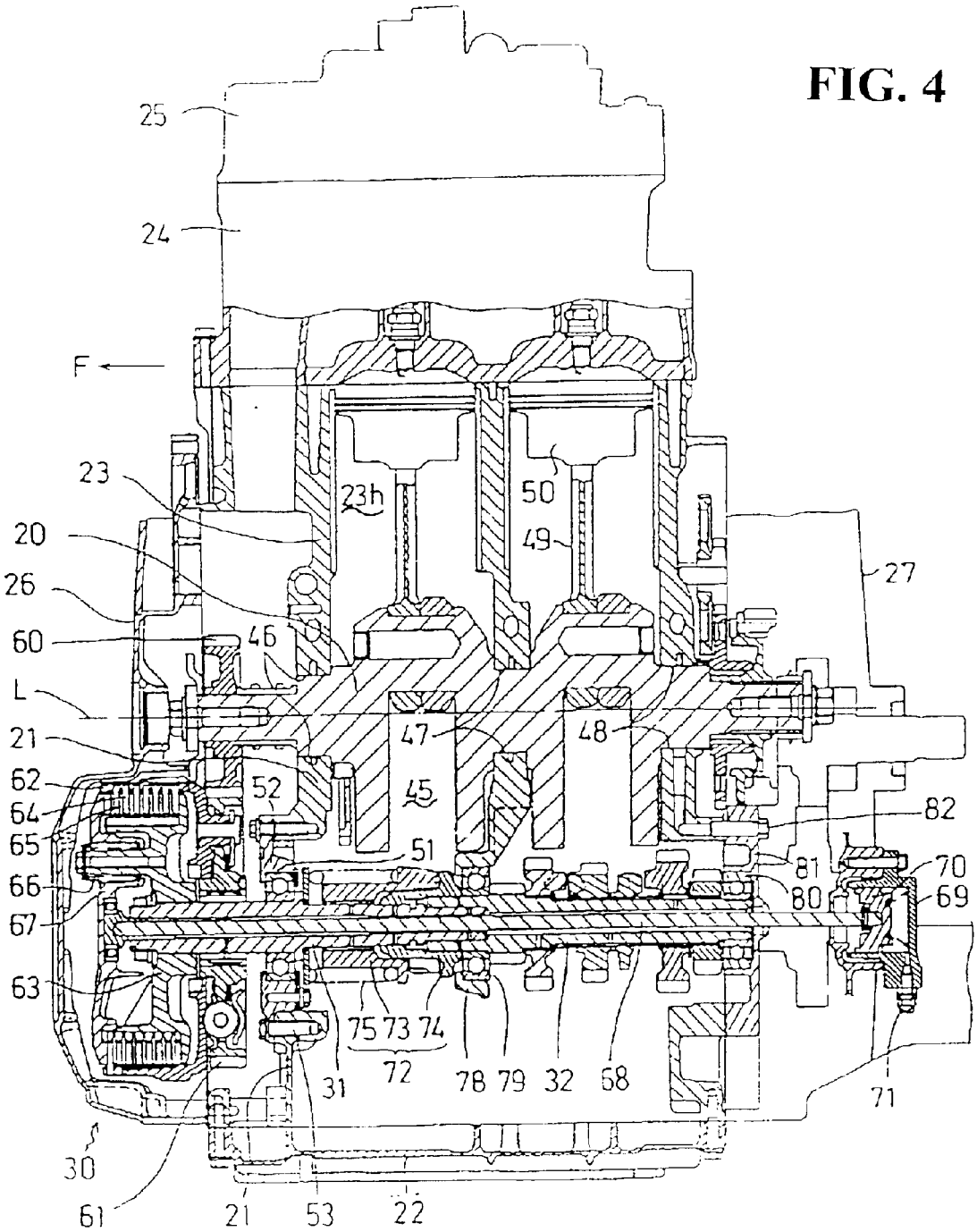
FIG. 4 is a cross sectional view taken along the line IV—IV in FIG. 3, showing a vertical cross section of one of the cylinder banks and the crankcase of the internal combustion engine.

FIG. 4 is a cross sectional view taken along the line IV—IV in FIG. 3 showing the vertical cross section of one of the cylinder banks of the internal combustion engine 10 and the crankcase. The arrow F indicates forward. The dashed line L indicates the centerline of the crankshaft. The body of the internal combustion engine 10 includes the crankcase 21 having the oil pan 22 connected at the bottom. The cylinder block 23 has left and right cylinder blocks and is connected to the upper end surface of the crankcase 21. The pair of left and right cylinder heads 24 is connected to the left and right cylinder blocks, respectively. The pair of left and right cylinder head covers 25 is connected to the aforementioned cylinder heads 24, respectively. A front crankcase cover 26 is connected to the aforementioned crankcase 21 and to the front surface of the cylinder block 23. Furthermore, a rear crankcase cover 27 is connected to the aforementioned crankcase 21 and the rear surface of the cylinder block 23.

In FIG. 4, the joint surface between the crankcase 21 and the cylinder block 23 is located at the centerline L of the crankshaft. The cylinder block 23 is formed with four cylinder bores 23*h* alternately on the left side and the right side with the centerline directed toward the centerline L of the crankshaft. The pair of left and right cylinder blocks is formed into the shape of a letter V. Two cylinder bores 23*h* out of four are shown in FIG. 4. In the following description of the present embodiment, the upper, lower, left, right, front, and rear designate the directions based on the perspective of a motorcycle driver.

A crank chamber 45 is defined by the crankcase 21 and the bottom of the cylinder block 23. The portions of the crankcase 21 and the cylinder block 23 that correspond to the interior of the crank chamber 45 are formed with a fore-crankshaft holding portion 46, a mid-crankshaft holding portion 47, and a rear-crankshaft holding portion 48 by the cooperation of the upper and lower corresponding portions. The crankshaft 20 is rotatably supported by plain bearings held in these shaft holding portions, respectively. A piston 50 is connected to the crankshaft 20 via a connecting rod 49, so as to reciprocate in each cylinder bore 23*h*. The crankshaft 20 is rotated by the reciprocating motion of the piston 50.

The multiple disk frictional clutch 30 is provided immediately below and forwardly of the crankshaft. This clutch 30 is supported on the crankcase 21 by holding the clutch output shaft 31 with a bearing holding member 52 via a ball bearing 51 and securing the holding member 52 on the crankcase 21 with a bolt 53. In this shaft holding structure with the bearing holding member 52, upsizing of the hole for assembling a cam-type torque damper 72 of large diameter can be accomplished. This will be described later. With the above structure, assembly can be facilitated.

The multiple disk frictional clutch 30 is a device for connecting and disconnecting power transmitted from the crankshaft 20 to the transmission mechanism. The multiple disk frictional clutch 30 includes an input gear 61 meshed with a gear 60 fixed on the crankshaft 20 and rotatably mounted on the output shaft 31 of the clutch 30. An outer clutch 62 is connected to the input gear 61. An inner clutch 63 is fixed on the output shaft 31 of the clutch 30. A plurality of frictional plates 64 is provided on the inner side of the outer clutch 62 so as to be slidable in the axial direction. A plurality of frictional plates 65 are disposed on the outside of the inner clutch 63 so as to be slidable in the axial direction and alternately with the frictional plates 64 of the outer clutch 62. A push plate 67 are provided for pushing the alternately disposed frictional plates 64, 65 toward each other in the axial direction by an urging force of a coil spring 66 so as to bring them into close contact. A push rod 68 is provided in the central bore of the output shaft 31 and the mainshaft 32 for pushing the push plate 67 against the urging force of the coil spring 66. A hydraulic unit 69 is mounted on the rear crankcase cover. A hydraulic piston 70 is provided in the hydraulic unit 69 and is connected to the end of the push rod 68. Furthermore, a hydraulic connecting port 71 is provided for supplying pressurized oil to the hydraulic unit 69. The clutch 30 is connected under normal condition, but when the clutch lever provided on the steering handle of the vehicle is operated to feed pressurized oil to the hydraulic unit 69, and the push plate 67 is moved via the push rod 68 to release the connection of frictional plates 64, 65, the clutch 30 is disconnected.

The mainshaft 32 of the gear shifter is connected via the cam-type torque damper 72 to the clutch output shaft 31. The torque damper 72 includes a pair of cams 73, 74 that mesh with each other with their inclined surfaces, and a coil spring 75. The cam 73 retracts against the urging force of the coil spring 75 to absorb the shock when a load torque is abruptly increased.

The mainshaft 32 of the gear shifter is supported at two points, front and rear. The front portion of the mainshaft 32 is supported by a fore-mainshaft holding portion 78 provided on the downward extension of the mid-crankshaft holding portion 47 on the crankcase via a ball bearing 79. The rear portion of the mainshaft 32 is held by a bearing holding member 81 via a ball bearing 80, and is supported by the crankcase 21 by securing the holding member 81 to the rear end portion of the crankcase 21 by a bolt 82.

Figure 5:
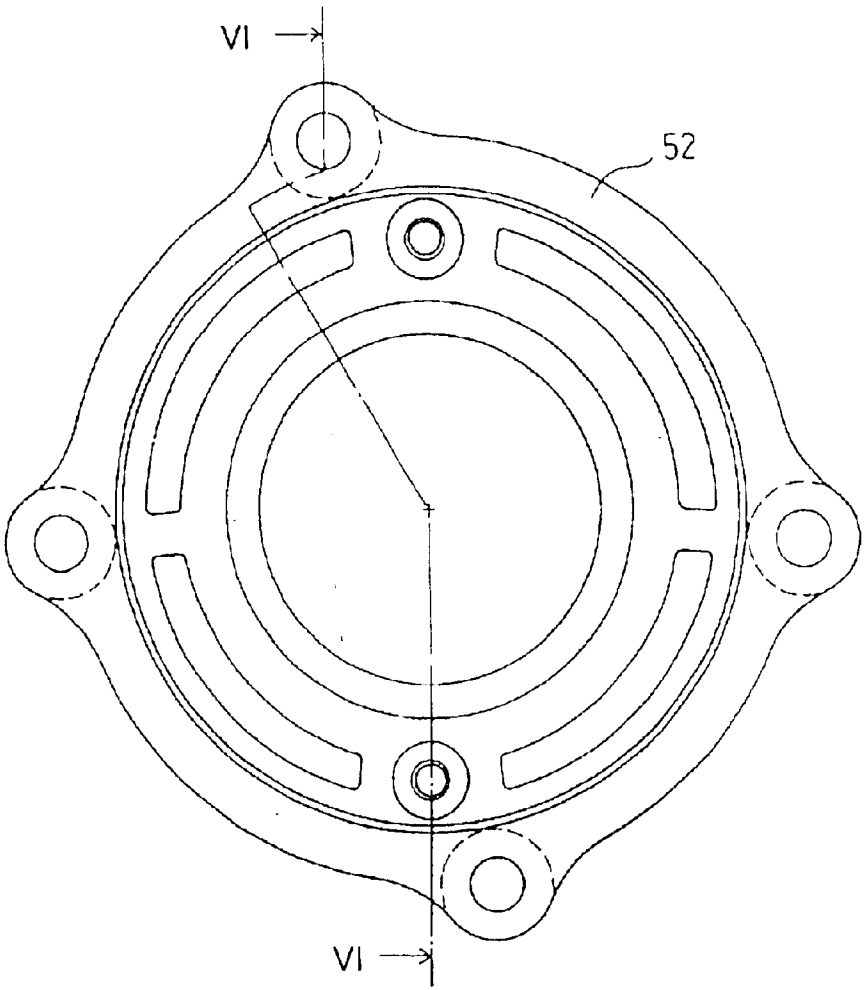
FIG. 5 is an enlarged back view of the bearing holding member for supporting the output shaft of the multiple disk frictional clutch.
Figure 6:
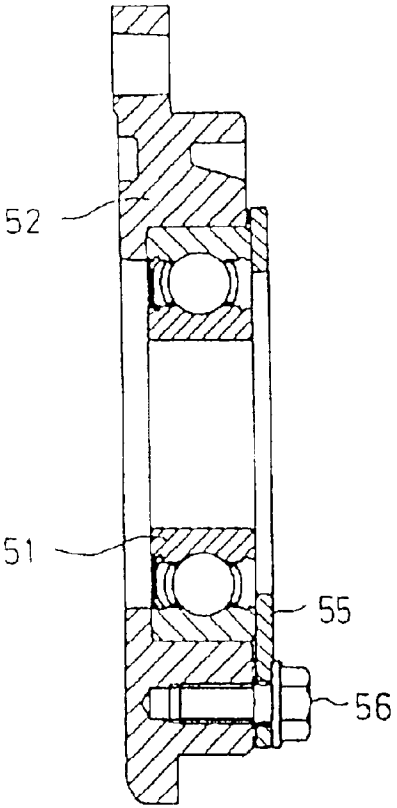
FIG. 6 is a cross-sectional view taken along the line VI—VI in FIG. 5, with a ball bearing, a push plate and a push plate mounting bolt added.

FIG. 5 is an enlarged back view of the bearing holding member 52. FIG. 6 is a cross sectional view taken along the line VI—VI in FIG. 5 with a ball bearing 51, a push plate 55, and a push plate mounting bolt 56 added. The push plate 55 is a ring-shaped plate. The outer race of the ball bearing 51 is fixed on the bearing holding member 52 by the push plate 55 mounted on the bearing holding member 52 by means of a bolt 56 to prevent it from falling. With a shaft holding structure with the interposition of the bearing holding member 52 according to the present invention, the cam-type torque damper 72 can be assembled through a hole for mounting the bearing holding member opened on the crankcase 21 in a state in which the bearing holding member is removed, thereby improving the assembly of the cam-type torque damper.

Figure 7:
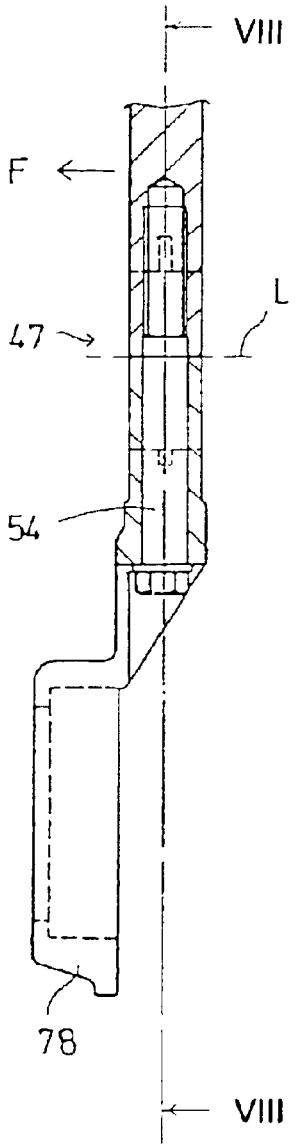
FIG. 7 is a cross sectional view along the line VII—VII in FIG. 8 showing the portion around the mid-crankshaft holding portion and the fore-mainshaft holding portion.
Figure 8:
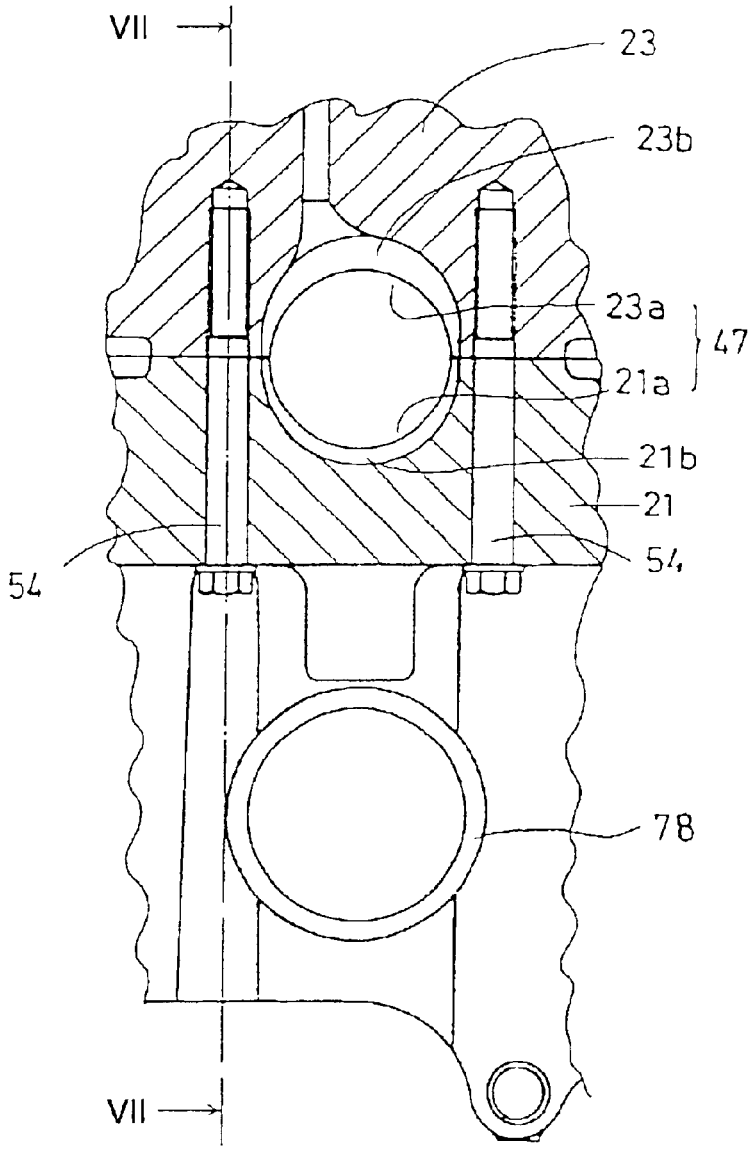
FIG. 8 is a cross-sectional view taken along the line VIII—VIII in FIG. 7

FIG. 7 is a cross sectional view along the line VII—VII in FIG. 8 showing the vicinity of the mid-crankshaft holding portion 47 and fore-mainshaft holding portion 78. FIG. 8 is a cross-sectional view along the line VIII—VIII in FIG. 7. FIG. 8 shows a state in which the crankcase 21 and the cylinder block 23 are connected by a fastening bolt 54 with the crankshaft 20 and the mainshaft 32 removed. The mid-crankshaft holding portion 47 is defined by a recess 21*a* provided on the crankcase 21 and a recess 23*a* provided on the cylinder block 23. The reference signs 21*b*, 23*b* designate oil grooves formed on each side. The fore-mainshaft holding portion 78 is provided downwardly of the mid-crankshaft holding portion 47. The fore-mainshaft holding portion 78 is, as shown in the FIG. 7, is formed at the position shifted toward the front (arrow F) to avoid interference with the extension of the tightening bolt 54 of the mid-crankshaft holding portion 47. Since the fore-mainshaft holding portion 78 is formed at a position avoiding interference with the tightening bolt 54 as described above, the length of the tightening bolt 54 may be shortened, and thereby assembly can be improved.

Figure 9:
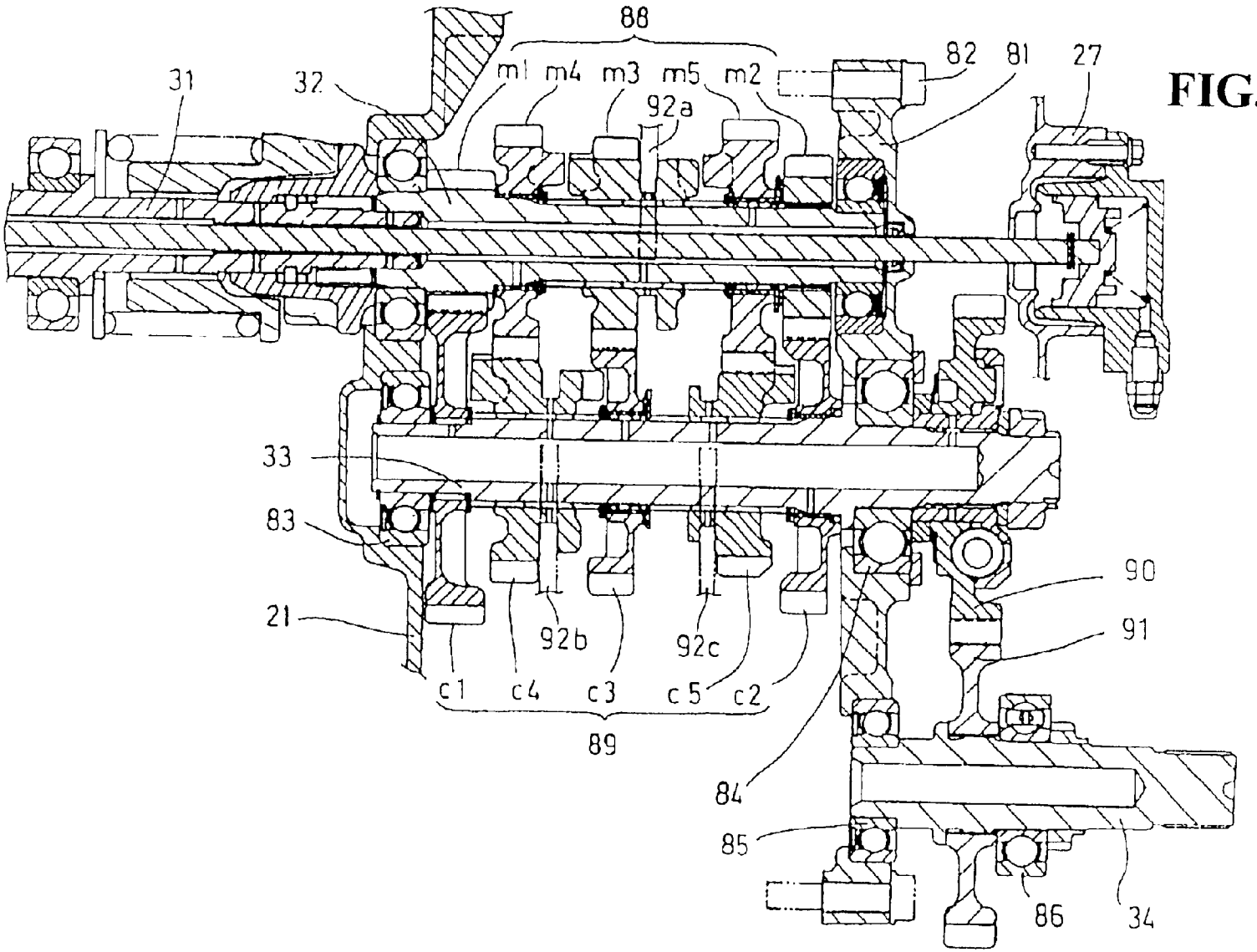
FIG. 9 is a development elevation of the mainshaft, the countershaft, and the output shaft continuing into the output shaft of the multiple plate frictional clutch.

FIG. 9 is a development elevation of the main shaft 32, the countershaft 33, and the output shaft 34 continuing into the output shaft 31 of the multiple plate frictional clutch. The front portion of the counter shaft 33 is supported by the crankcase 21 via a ball bearing 83. The bearing holding member 81, which is the same member as the one holding the rear portion of the mainshaft 32, holds the rear portion of the countershaft 33 and the front portion of the output shaft 34 via the ball bearings 84, 85 respectively. The bearing holding member 81 is attached on the crankcase 21 by means of a bolt 82. The rear crankcase cover 27 supports the rear portion of the output shaft 34 via the ball bearing 86.

The mainshaft 32 is provided with a gear set 88 including gears m1–m5, and the countershaft 33 is provided with a gear set 89 including gears c1–c5 corresponding respectively to the aforementioned gear set 88 and a drive gear 90. A driven gear 91 to be meshed with the aforementioned drive gear 90 is provided on the output shaft 34. In the aforementioned gear set, the gears m1, m2, m3, m4, m5 correspond to first gear, second gear, third gear, fourth gear, and fifth gear. Likewise, the gear set c1–c5 also corresponds to the first to fifth gear.

Though the gears m1 and m2 out of the gear sets 88, 89 are fixed gears fixed on the shaft, the gears c1, c2, c3, m4, m5, being immovable in the axial direction but free in the circumferential direction, are freely rotatable gears. Hereinafter, these gears are referred to as floating gears. The gears m3, c4, and c5 are spline-fitted on the shaft and thus constrained by the shaft in the circumferential direction, but are slidable in the axial direction. Hereinafter these gears are referred to as sliding gears. Sliding gear m3 meshes with a shift fork 92*a*, sliding gear c4 meshes with a shift fork 92*b*, and sliding gear c5 meshes with a shift fork 92*c*. These shift forks are controlled by a shift operation mechanism that will be described later.

Figure 10:
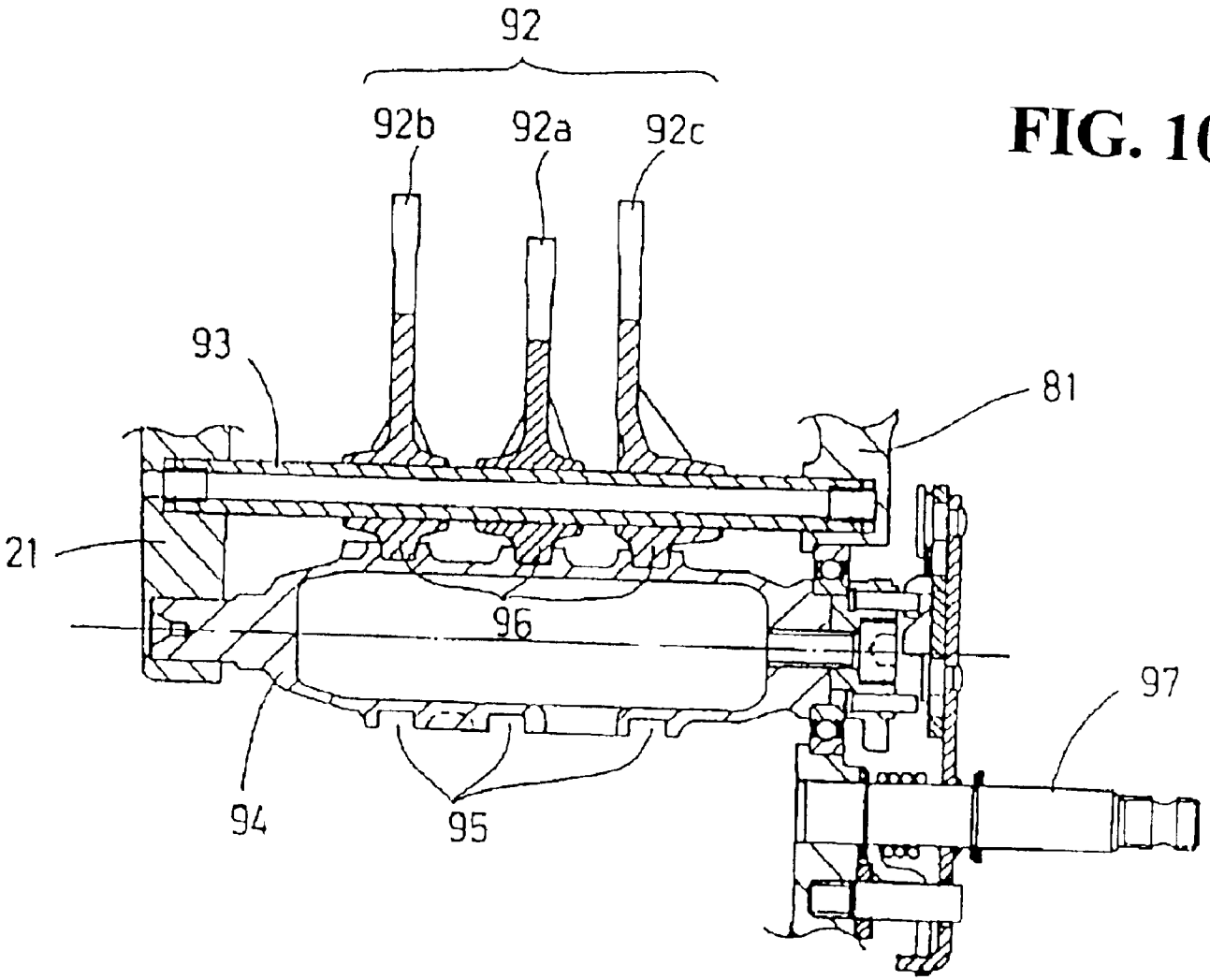
FIG. 10 is a development elevation of the shift operation mechanism.

FIG. 10 is a development elevation of the shift operation mechanism. The shift forks 92*a*, 92*b*, 92*c* are held by a supporting shaft 93 so as to be slidable in the axial direction. The supporting shaft 93 is fixed to the crankcase 21 at the front and to the shaft holding member 81 at the rear. Adjacent to the supporting shaft 93 and in parallel with the supporting shaft 93, a shift drum 94 is rotatably held by the crankcase 21 at the front and by the bearing holding member 81 at the rear. A shift pin 96 projected from each shift fork engages a groove 95 on the shift drum 94. The shift drum 94 rotates in conjunction with a shift spindle 97, which is rotated by the operation of the transmission lever (not shown) mounted on the steering handle of the vehicle, to move any one of the shift forks 92 via the shift pin 96 fitted in the groove 95, and hence each shift fork moves any one of the sliding gears that mesh therewith.

In FIG. 9, the sliding gear m3 that rotates integrally with the mainshaft 32 moves on the mainshaft 32 in the axial direction due to the operation of the shift fork 92*a*, and selectively meshes with one of the floating gear m4 and the floating gear m5. The meshed floating gear rotates integrally with the mainshaft. The floating gear m4 or m5 drives the sliding gear c4 or c5 on the countershaft 33 being at the neutral position and meshes correspondingly, so that transmission to the fourth gear or the fifth gear is performed.

In the same manner, the sliding gear c4 that rotates integrally with the countershaft 33 moves on the countershaft 33 in the axial direction due to the operation of the shift fork 92*b* and selectively meshes with one of the floating gear c1 and the floating gear c3. The meshed floating gear rotates integrally with the countershaft 33. The floating gear c1 or the floating gear c3 is driven by the fixed gear m1 or by the sliding gear m3 being in the neutral position on the mainshaft 32 that mesh correspondingly therewith, and thus transmission to the first gear or to the third gear is performed.

Furthermore, the sliding gear c5 rotating integrally with the countershaft 33 moves axially on the countershaft 33 due to the operation of the shift fork 92*b* and engages with the floating gear c2. The floating gear c2 rotates integrally with the countershaft, and is driven by the fixed gear m2 on the mainshaft 32 that meshes correspondingly therewith, so that transmission to the second gear is performed.

The rotation of the countershaft 33 the speed of which is changed is transmitted to the output shaft 34 by the drive gear 90 and the driven gear 91 that meshes therewith, and finally drives the rear wheel of the vehicle.

Figure 11:
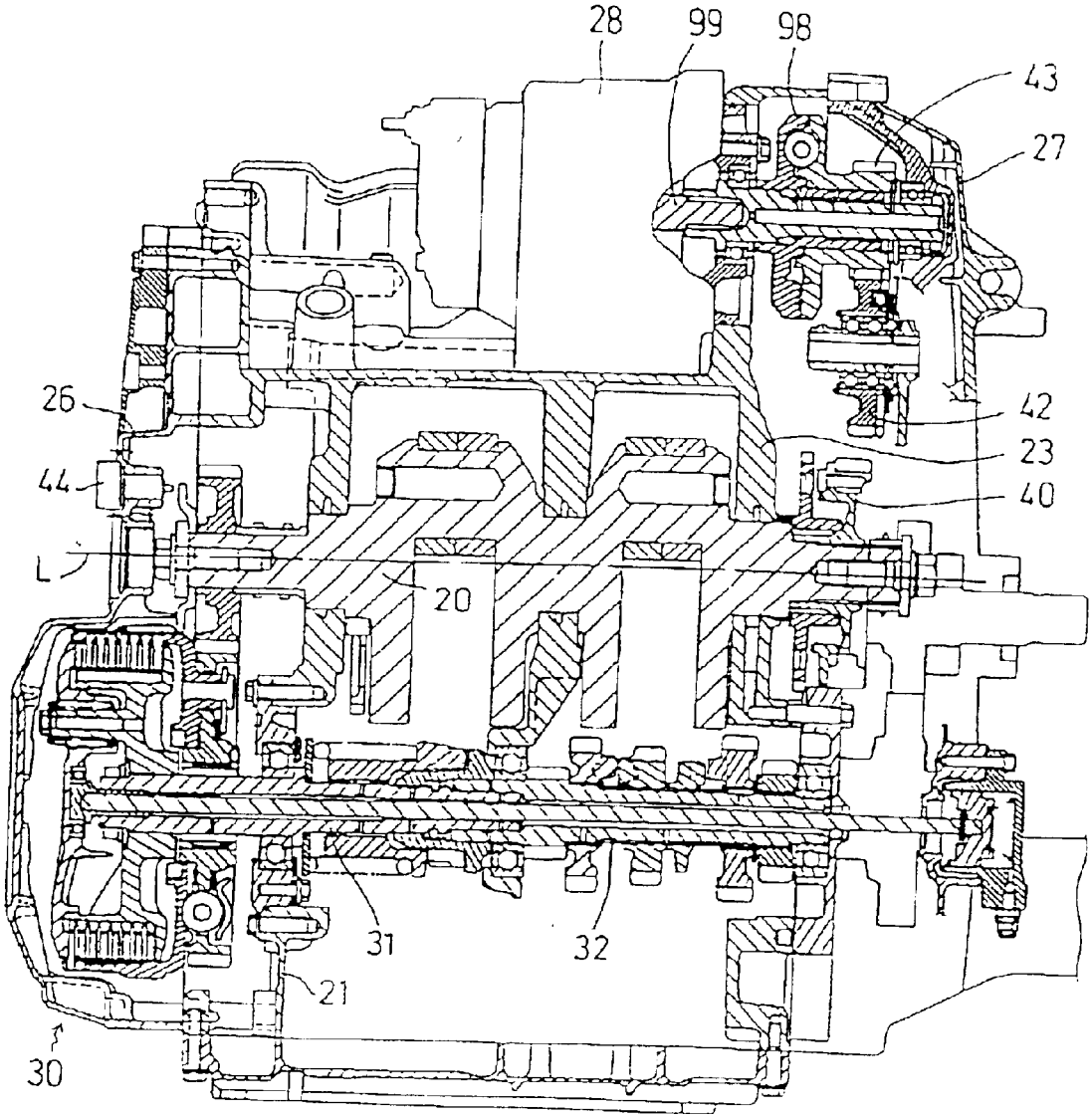
FIG. 11 is a vertical cross sectional view taken along the line XI—XI in FIG. 3 showing an alternate-current generator disposed immediately above the crankcase and the crankshaft.

FIG. 11 is a vertical cross sectional view taken along the line XI—XI in FIG. 3 showing the alternate-current generator 28 disposed immediately above the crankcase 21 and the crankshaft 20. The alternate-current generator 28 is, as shown in FIG. 3, driven by the gear train continuing from the gear 40 fixed on the crankshaft to the gears 41, 42, 43. In FIG. 11, the gear 41 is not shown and other gears 40, 42, and 43 are shown. The gear train is located between the cylinder block 23 and the rear crankcase cover 27. The rotation of the gear 43 is transmitted to the revolving shaft 99 of the alternate-current generator 28 via a joint 98 with a damper to generate electricity.

A crank pulser 44 is mounted on the front crankcase cover 26 in the vicinity of the centerline L of the crankshaft. The position on the front surface of the internal combustion engine is shown by a chain double-dashed line in FIG. 2. This apparatus is an apparatus for detecting the position of the crank and the revolution of the crankshaft. It is superior in maintenance since it can be mounted from the front side of the front cover 26.

In this arrangement, the present embodiment has the following operation and the effects.

The mainshaft is disposed in the vicinity of the crankshaft immediately below the crankshaft and the clutch, which has a large diameter is connected on the forward extension of the mainshaft. Accordingly, the clutch, which has a large diameter is positioned at the lateral center of the internal combustion engine when viewed from the front. Therefore, the lateral width of the internal combustion engine can be reduced.

The mainshaft is disposed downwardly of and in parallel with the crankshaft, and at least a part of the mainshaft is located at the same axial position as the crankshaft. In other word, the mainshaft and the crankshaft are superimposed when viewed from a certain position on the side of the shaft. Accordingly, the axial length of the internal combustion engine may be reduced in comparison with the internal combustion engine disclosed in the patent No. 2858017, and oil dropped after lubricating the piston and the crank may be utilized for lubrication of the gear train on the mainshaft.

The crank chamber is defined by the upper and lower case members, or the lower portion of the cylinder block and the crankcase. Accordingly, the crankshaft is held between the upper and lower case members. The mainshaft is attached on the lower case member so that the axial positions of at least a part of the mainshaft bearing and the crank bearing are shifted to avoid superimposition. Furthermore, the length of the bolt to secure the crankshaft bearing may be shortened. Accordingly, the workability may be improved.

The internal combustion engine of the present embodiment is mounted on the motorcycle so that the crankshaft is oriented lengthwise of the vehicle body. Accordingly, the lateral width of the internal combustion engine may be reduced, thereby reducing the front projected area of the vehicle and ensuring better knee-grip. In addition, since the lengthwise dimension of the internal combustion engine is short, in-vehicle mountability is improved.

The internal combustion engine in the present embodiment is a V-type internal combustion engine. Accordingly, the height of the central portion of the internal combustion engine can be reduced and thus in-vehicle mountability is improved.

Equipment or members of large diameter of the alternate-current generator, the crankshaft, and the mainshaft are arranged vertically on the center plane of the internal combustion engine. Accordingly, the width of the internal combustion engine may be reduced.

The alternate-current generator is driven by the gear train. Accordingly, the space required for the transmission member is smaller than the case where a chain or the like is applied. In addition, the direction of revolution of the alternate-current generator is opposite from the direction of revolution of the crankshaft. Accordingly, the mass of the alternate-current generator can be used as a reverse torque balancer of the mass of the crank.

The starter of the internal combustion engine is disposed on the opposite side from the alternate-current generator driving gear train with respect to the center plane of the internal combustion engine. Accordingly, the lateral weight balance of the internal combustion engine is improved. Furthermore, the oil pump is disposed on the opposite side from the countershaft with respect to the center plane of the internal combustion engine. Accordingly, the lateral weight balance of the internal combustion engine is improved. In addition, the crank pulser is attached on the front crankcase cover. Accordingly, the maintenance is improved.

In this arrangement, the present embodiment has the following operation and the effects.

(1) In the present embodiment, the mainshaft and the cam-type torque damper are disposed downwardly of the crankshaft in the crankcase. Accordingly, the entire length of the internal combustion engine in the direction of the crankshaft may be reduced in comparison with the internal combustion engine in which the mainshaft is disposed rearwardly of the crankshaft.

(2) The mainshaft is disposed downwardly of the crankshaft. Accordingly, the mainshaft and the gear shifter continuing therefrom can be accommodated in the crankcase. Therefore, the need to provide a transmission case can be eliminated. Furthermore, the mainshaft and the cam-type torque damper are disposed downwardly of the crankshaft. Accordingly, oil dropped after lubricating the piston or the crank may be used for lubricating the gear set of the mainshaft and the cam-type torque damper.

(3) A clutch output shaft supporting bearing between the clutch and the cam-type torque damper is secured to the crankcase via a bearing holding member. Accordingly, the cam-type torque damper can be assembled through a hole for mounting the large bearing holding member before mounting the bearing holding member. Therefore, the assembly of the cam-type torque damper can be improved.

(4) In the internal combustion engine of the present embodiment, the entire length of the internal combustion engine in the direction of the crankshaft is short. Accordingly the length of the wheelbase of the vehicle can be shortened by mounting the crankshaft lengthwise of the vehicle.

(5) The internal combustion engine of the present embodiment is constructed as a V-type internal combustion engine. Accordingly, the vertical height of the central portion of the internal combustion engine can be reduced. Therefore, the in-vehicle mountability can be improved.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. An internal combustion engine, comprising:

a crankshaft;

a mainshaft of a transmission, said mainshaft holding a transmission gear train;

a clutch, said clutch being disposed on an extension of said mainshaft; and a countershaft of the transmission, said countershaft for holding a gear train to be meshed with the transmission gear train, wherein power is transmitted in order from the crank shaft to the clutch, the main shaft, and the countershaft, and said mainshaft is disposed substantially directly below said crankshaft, and wherein a crank chamber is defined by upper and lower case members, said crankshaft is held between the upper and the lower case members, the mainshaft is adapted to be attached on the lower case member, and at least a part of a crank bearing and a main bearing are shifted with respect to each other so as to be located at different axial positions.

2. The internal combustion engine according to claim 1, wherein at least a part of the mainshaft is disposed at a same axial position as said crankshaft.

3. The internal combustion engine according to claim 2, wherein a crank chamber is defined by upper and lower case members, said crankshaft is held between the upper and the lower case members, the mainshaft is adapted to be attached on the lower case member, and at least a part of a crank bearing and a main bearing are shifted with each other so as to be located at different axial positions.

4. The internal combustion engine according to claim 3, wherein said internal combustion engine is mounted on a motorcycle with said crankshaft oriented lengthwise of the motorcycle.

5. The internal combustion engine according to claim 4, wherein the internal combustion engine is a V-type internal combustion engine.

6. The internal combustion engine according to claim 2, wherein said internal combustion engine is mounted on a motorcycle with said crankshaft oriented lengthwise of the motorcycle.

7. The internal combustion engine according to claim 6, wherein the internal combustion engine is a V-type internal combustion engine.

8. The internal combustion engine according to claim 1, wherein said internal combustion engine is mounted on a motorcycle with said crankshaft oriented lengthwise of the motorcycle.

9. The internal combustion engine according to claim 8, wherein the internal combustion engine is a V-type internal combustion engine.

10. The internal combustion engine according to claim 1, wherein said internal combustion engine is mounted on a motorcycle with said crankshaft oriented lengthwise of the motorcycle.

11. The internal combustion engine according to claim 10, wherein the internal combustion engine is a V-type internal combustion engine.

12. An internal combustion engine, comprising:

a crankshaft;

a mainshaft of a transmission, said mainshaft for holding a transmission gear train;

a cam-type torque damper, said torque damper being disposed on an axis of said mainshaft;

a clutch, said clutch being disposed on an extension of said mainshaft; and a countershaft of the transmission, said countershaft for holding a gear train to be meshed with the transmission gear train, wherein power is transmitted in order from the crankshaft to the clutch, the cam-type torque damper, the mainshaft, and the countershaft, and the mainshaft and the cam-type torque damper are disposed downwardly of the crankshaft in a crankcase of the engine.

13. The internal combustion engine according to claim 12, wherein a bearing between the clutch and the cam-type torque damper is secured to the crankcase via a bearing holding member.

14. The internal combustion engine according to claim 13, wherein the internal combustion engine is mounted on a motorcycle with the crankshaft oriented lengthwise of the motorcycle.

15. The internal combustion engine according to claim 14, wherein the internal combustion engine is a V-type internal combustion engine.

16. The internal combustion engine according to claim 12, wherein the internal combustion engine is mounted on a motorcycle with the crankshaft oriented lengthwise of the motorcycle.

17. The internal combustion engine according to claim 16, wherein the internal combustion engine is a V-type internal combustion engine.

* * * * *